US006578505B2

(12) United States Patent
Berzack

(10) Patent No.: US 6,578,505 B2
(45) Date of Patent: Jun. 17, 2003

(54) ANTI-COUNTERFEITING SYSTEM AND METHOD FOR AUTHENTICATING MANUFACTURED ARTICLES

(75) Inventor: Harry L. Berzack, Charlotte, NC (US)

(73) Assignee: Counterfeit Control Company, LLC, Charlotte, NC (US)

( * ) Notice: Subject to any disclaimer, the term of this patent is extended or adjusted under 35 U.S.C. 154(b) by 21 days.

(21) Appl. No.: 09/927,486

(22) Filed: Aug. 10, 2001

(65) Prior Publication Data

US 2003/0029005 A1 Feb. 13, 2003

(51) Int. Cl.[7] ..... D05B 03/14; A44B 01/20
(52) U.S. Cl. ..... 112/475.15; 24/114.7
(58) Field of Search ..... 112/475.15, 108, 112/110, 113, 65, 76, 77; 2/265; D11/222, 223, 227, 228; 24/40, 90.1, 114.7, 114.8, 114.9, 114.11, 578.11, 578.12; 79/1, 2, 3, 6, 7, 10, 11

(56) References Cited

U.S. PATENT DOCUMENTS

| | | | | |
|---|---|---|---|---|
| 680,121 A | * | 8/1901 | Burns | 24/114.7 |
| 2,023,457 A | * | 12/1935 | White | 24/114.7 |
| 2,025,663 A | * | 12/1935 | Iuliano | 24/114.7 |
| 2,081,485 A | * | 5/1937 | Knott | 24/90.1 |
| 4,154,177 A | | 5/1979 | Rockerath et al. | |
| 4,194,272 A | * | 3/1980 | Taffurelli | 24/114.7 |
| 4,436,041 A | | 3/1984 | Taddicken | |
| 4,512,271 A | | 4/1985 | Herdeg et al. | |
| 4,690,077 A | | 9/1987 | Nirenberg | |
| 4,705,167 A | | 11/1987 | Nakamura | |
| 4,821,661 A | | 4/1989 | Brownlee | |
| 5,062,373 A | | 11/1991 | Kichizo et al. | |
| 5,088,428 A | | 2/1992 | Frye | |
| 5,445,091 A | | 8/1995 | Bartholoma | |
| 5,540,162 A | | 7/1996 | Schopf et al. | |
| 5,899,156 A | | 5/1999 | Schopf et al. | |
| 6,234,096 B1 | | 5/2001 | Suh | |

OTHER PUBLICATIONS

"Automatic Feeding M/C for Safety Inside Button"; Korea Patent No. 118713; Printed prior to Aug. 10, 2001; Entire Brochure.

JUKI Corporation; "Computer–controlled, Dry–head, High–speed, Single–thread, Chainstitch Button Sewing Machine—MB–1800S—MB–1800B—MB–1800A/BR10"; Printed in Japan; Jul., 2000; Entire Brochure.

Seung II Automatic Precision Co.; "Flat Button Robot BR–120M—Automatic Flat Button Feeding Attachment for Chainstitch Button Sewing M/C"; Korea; Printed prior to Aug. 10, 2001, Entire Brochure.

JUKI Corporation; Single–thread, Chain Stitch, Button Sewing Machine with Knot–tying Mechanism—MB–377, MB0377A/BR10 (With an Automatic Button Feeder); Printed in Japan; Aug., 1996; Entire Brochure.

JUKI Corporation; "Single–thread, Chainstitch, Button Sewing Machine with an Automatic Button Feeder—MB–373N/BR10"; Printed in Japan; Oct. 1990, Entire Brochure.

"Safety Inside Button"; Korea Patent No. 118714, 201889; Printed prior to Aug. 10, 2001; Entire Brochure.

"Upper & Lower Button Robot BR–120LB—Automatic Upper & Lower Button Feeding Attachment for Chainstitch Button Sewing M/C's with Trimmer"; Printed prior to Aug. 10, 2001; Entire Brochure.

* cited by examiner

*Primary Examiner*—Ismael Izaguirre
(74) *Attorney, Agent, or Firm*—Schwartz Law Firm, P.C.

(57) ABSTRACT

A button is adapted for use in an anti-counterfeiting system and method for authenticating a manufactured article. The button defines at least five holes adapted for receiving thread to attach the button to the manufactured article.

12 Claims, 3 Drawing Sheets

ANTI-COUNTERFEITING SYSTEM AND METHOD FOR AUTHENTICATING MANUFACTURED ARTICLES

TECHNICAL FIELD AND BACKGROUND OF THE INVENTION

This invention relates to an anti-counterfeiting system and method for authenticating manufactured articles, such as apparel and other soft goods. The invention is intended to safeguard both manufacturers and consumers against counterfeiting. The invention utilizes a conspicuous 5-hole button permanently affixed to the article and used to identify the article as genuine. While the identifier itself is relatively inexpensive, the machinery and software required to attach the buttons to a mass quantity of apparel is not.

Many successful corporations spend millions of dollars in advertising and other marketing efforts to create brand names and generate good will. In some cases, further millions are spent in developing products to be marketed under these brand names. Successful brand names represent a valuable asset of a corporation, and are often the focus of great efforts undertaken to police their proper and authorized use. Despite these efforts, successful brand names have been wrongfully exploited for years by unscrupulous manufacturers and resellers of counterfeit products. The apparel industry in particular has been and continues to be subjected to widespread counterfeiting.

The actual lost sales attributed to counterfeiting is but one aspect of this problem. An often more serious result is the damage done to the good name and reputation of the brand owner when inferior counterfeited merchandise is sold as genuine. In an effort to counteract the problem, brand name owners have been aggressively pursuing counterfeiters, and introducing programs intended to eliminate or at least reduce counterfeiting. While some programs have met rather limited short term success, the end rewards to the counterfeiters are often so large that the programs themselves have been copied.

According to one such program, brand-authenticating holographs are incorporated into either the product packaging or a swing tag, or placed on the packaging or product in the form of a self-adhesive decal. While once considered a novel and innovative approach, holograph technology is now well known, and the cost of entry into the holograph manufacturing industry is low. In today's market, counterfeit holographs are commonplace. In another anti-counterfeiting program, a hidden authenticating device is incorporated into the product. This approach is problematic, as it is generally difficult to control and lacks standardization with regard to where to place the device. While the hidden device is detectable by field inspectors checking a reseller's inventory, consumers are generally unaware of the device, and are likewise unaware of whether the merchandise is counterfeit or genuine. A still further approach uses moving image labels (including 3D) typically manufactured with a paper printing image including PVC reflectors. This method, however, is unsuitable as a sew-in label or tag in apparel and footwear. Furthermore, the technology is well known, thus leading to the same problems realized by holographs.

In view of these drawbacks and limitations of the prior art, what is needed in the anti-counterfeiting industry is a brand authentication system which cannot be readily copied, and which utilizes an identifier that is sufficiently conspicuous to the ordinary consumer. The technology must be difficult to duplicate with the cost of entry into the market to produce the identifier so high as to discourage the investment. The number of companies capable of duplicating the technology would be low and the chance of being caught too high.

The present invention provides a solution for reducing counterfeiting in soft goods. While the system of the invention could theoretically be copied, the cost of doing so—and the risk of being caught—would be too high to justify the rewards. By incorporating consumer education into the system and advertising the method of detecting counterfeit products, the market for counterfeit goods sold as genuine would be greatly curtailed. It is recognized that this would not stop consumers from purchasing counterfeit merchandise, such as apparel, if the consumer's motivation was solely to own a product brandishing the brand name.

SUMMARY OF THE INVENTION

Therefore, it is an object of the invention to provide an anti-counterfeiting system and method for authenticating manufactured articles.

It is another object of the invention to provide an anti-counterfeiting system which utilizes a specially designed 5-hole button sewn onto the top of the product, and simultaneously, a 5-hole stay button sewn to the underside of the product.

It is another object of the invention to provide an anti-counterfeiting system which utilizes a set of buttons—a top button and a stay button—wherein the top button includes the trademark of the brand owner.

It is another object of the invention to provide an anti-counterfeiting system which utilizes a set of buttons—a top button and a stay button—wherein the stay button is color-coded to indicate brand participation in the anti-counterfeiting system.

It is another object of the invention to provide an anti-counterfeiting system which utilizes a specially designed cam in a mechanical-type sewing machine for attaching the 5-hole buttons to the product.

It is another object of the invention to provide an anti-counterfeiting system which utilizes an electronic-type sewing machine with computer-controlled stitch patterns suitable for attaching the 5-hole buttons to the product.

It is another object of the invention to provide an anti-counterfeiting system wherein both of the top and bottom buttons are supplied in sets to the brand owners, who would then control their distribution to manufacturers.

It is another object of the invention to provide an anti-counterfeiting system which utilizes 5-hole buttons that would be impractical to attach to the brand product manually.

It is another object of the invention to provide an anti-counterfeiting system which readily identifies genuine products.

It is another object of the invention to provide an anti-counterfeiting system which is relatively easy to police.

It is another object of the invention to provide an anti-counterfeiting system which is relatively difficult to replicate.

It is another object of the invention to provide an anti-counterfeiting system which promotes support through an advertising campaign, putting customers, vendors and manufacturers on alert against counterfeiting and the penalties that may result.

It is another object of the invention to provide an anti-counterfeiting system which promotes support by subjecting pirates to multiple legal causes of action.

It is another object of the invention to provide an anti-counterfeiting system which has a centralized control and supply of buttons.

It is another object of the invention to provide an anti-counterfeiting system which promotes the ability to control licensees and collect royalties.

It is another object of the invention to provide an anti-counterfeiting system which utilizes an electronic counter incorporated into the sewing machine to monitor the production of the machine.

These and other objects of the present invention are achieved in the preferred embodiments disclosed below by providing a button adapted for use in an anti-counterfeiting system for authenticating a manufactured article. The button defines at least five holes adapted for receiving thread to attach the button to the manufactured article.

According to another preferred embodiment of the invention, the button is a top button adapted for residing on an outside surface of the manufactured article.

According to another preferred embodiment of the invention, the button is a relatively thin, circular disk having a center point and notional quadrants.

According to another preferred embodiment of the invention, the button defines a center hole at the center point, and four quadrant holes outside of the center hole and located within respective notional quadrants.

According to another preferred embodiment of the invention, the quadrant holes are equally spaced approximately 90 degrees apart.

According to another preferred embodiment of the invention, each of the quadrant holes is equally spaced from the center hole of the button.

According to another preferred embodiment of the invention, the diameter of the center hole is greater than the diameter of the quadrant holes.

According to another preferred embodiment of the invention, the button is a stay button adapted for residing on an inside surface of the manufactured article.

According to another preferred embodiment of the invention, the stay button defines opposing major surfaces, and includes a projecting cloverleaf configuration formed on one of the major surfaces.

In another embodiment, the invention is an anti-counterfeiting method for authenticating a manufactured article. The method includes the step of attaching a button to the manufactured article, the button defining at least five holes.

According to another preferred embodiment of the invention, the step of attaching the button includes stitching a thread through each of the five holes of the button and the article.

According to another preferred embodiment of the invention, the step of attaching the button further includes making a first stitch through the center one of the holes of the button.

According to another preferred embodiment of the invention, the step of attaching the button includes using a single-thread chainstitch button sewing machine.

According to another preferred embodiment of the invention, the step of attaching the button includes stitching the button to an outside surface of the manufactured article.

In another embodiment, the invention is an anti-counterfeiting method which includes the steps of attaching a five-hole top button to an outside surface of the manufactured article and a stay button to an inside surface of the manufactured article. The stay button underlies the top button adjacent the inside surface of the manufactured article.

According to another preferred embodiment of the invention, the step of attaching the top button includes stitching a thread through each of the five holes of the top button, the article, and the underlying stay button.

According to another preferred embodiment of the invention, the step of attaching the top button further includes making a first stitch through a center one of the five holes.

According to another preferred embodiment of the invention, the step of attaching the top button and the stay button to the article includes using a single-thread chainstitch button sewing machine.

According to another preferred embodiment of the invention, the stay button defines five holes, and the step of attaching the five-hole top button and the stay button to the article includes aligning the holes of the top button and the stay button, and stitching a single thread through each of the aligned holes and article.

According to another preferred embodiment of the invention, the step of attaching the top button and the stay button to the article further includes making a first stitch through respective aligned center holes formed in the top button and stay button.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
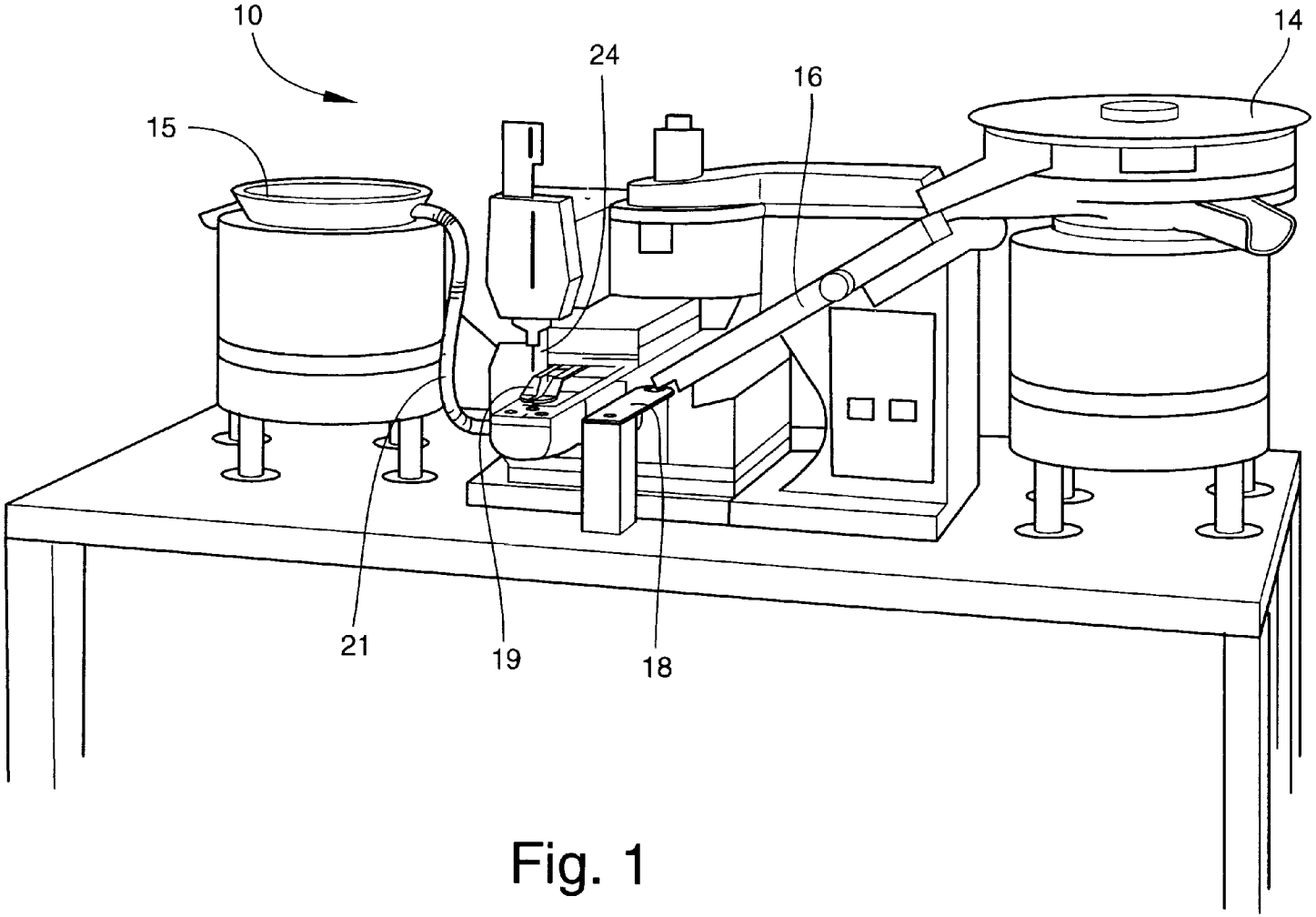
FIG. 1 is a perspective view of a button sewing machine applicable for simultaneously attaching a set of 5-hole buttons to an article of apparel.
Figure 2:
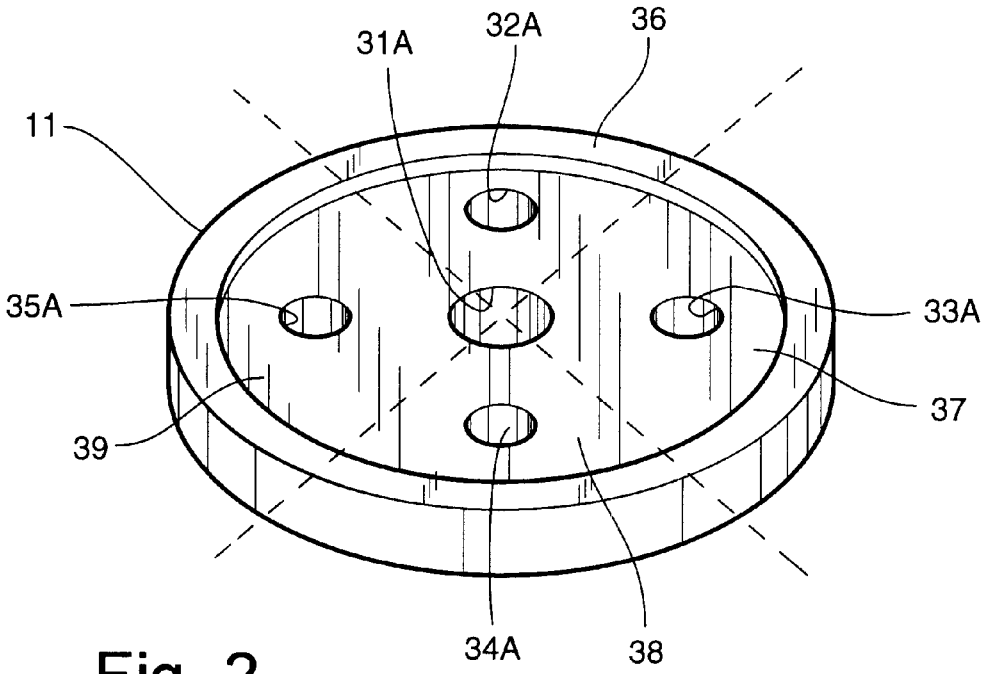
FIG. 2 is a perspective view of a 5-hole top button in face-up position.
Figure 3:
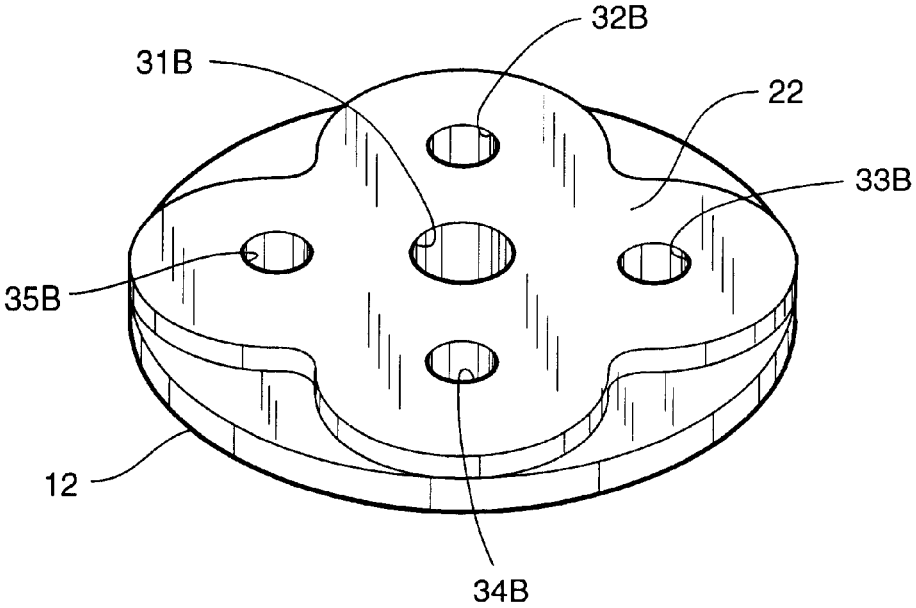
FIG. 3 is a perspective view of a 5-hole stay button in a face-down position.

Referring now specifically to the drawings, a sewing machine adapted for simultaneously attaching a 5-hole top button and stay button to a manufactured article of apparel is illustrated in FIG. 1 and shown generally at reference numeral 10. The buttons 11 and 12, shown in FIGS. 2 and 3, are preferably sewn together on opposing outside and inside surfaces of the article using a single-thread chainstitch. The article of apparel may comprise any clothing item, such as men's and women's knit shirts, dress shirts, blouses, slacks, jeans, shorts, skirts, socks, and the like. The 5-hole buttons 11, 12 may be attached either as a functional or decorative component of the article, or specifically as a brand identifier. In either case, at least one of the buttons 11, 12 would be readily visible to a consumer choosing to purchase the article. While the present anti-counterfeiting system is especially useful in the apparel industry, the principle of the invention is applicable to any manufactured article for purposes of authenticating its source. Specifically, the invention is further applicable to other soft goods, such as bed sheets, towels, linens, and the like.

Referring to FIG. 1, the sewing machine 10 is a conventional, electronic, single-thread chainstitch sewing machine with an internal looper (not shown). Examples of chainstitch sewing machines are disclosed in prior U.S. Pat. Nos. 5,899,156; 5,445,091; and 4,821,661 owned by Union Special GmbH. The complete disclosure of these patents is incorporated herein by reference. The top and stay buttons 11 and 12 are supplied to the sewing machine 10 in respective hoppers 14 and 15. The buttons 11, 12 in each hopper 14, 15 are separated and arranged face-up in a single line for transport to the sewing machine 10. The 5-hole top buttons 11 are fed through, for example, a declined guide chute 16. At a discharge end of the guide chute 16, the buttons 11 are rotated to align their button holes with two or more projecting pins formed at a free end of a pivoted transfer arm 18. The transfer arm 18 receives each button 11, one at a time, and swings the button 11 into position on the article where the button 11 is clamped between the jaws of a holding device 19. Once clamped, the transfer arm 18 returns to its button loading position to receive the next top button 11 discharged from the guide chute 16.

The 5-hole stay buttons 12 likewise pass face-up in single-line succession from the hopper 15 through a guide tube 21 to the sewing machine 10. At the discharge end of the guide tube 21, the stay button 12 is rotated to align its holes with the holes of the top button 11. As shown in FIG. 3, the underside of the stay button 12 defines a projecting design 22, such as a cloverleaf design, which mates with a corresponding shaped recess formed in a holder (not shown) used to position the stay button 12 beneath the fabric and top button 11. Once positioned, the sewing needle 24 stitches a single thread through the aligned button holes to simultaneously attach the two buttons 11, 12 to opposite sides of the article. Examples of devices for feeding stay buttons to a sewing machine are provided in prior U.S. Pat. Nos. 4,705,167 and 4,436,041, and Korean Patent Nos. 118,713; 118,714; and 201,889. The disclosure of each of these patents is incorporated herein by reference.

Referring to FIGS. 2 and 3, the five holes of each button 11, 12 are arranged in exact correspondence in order to chainstitch the two buttons 11, 12 to the article simultaneously using a single thread. Each button 11, 12 has an enlarged center hole 31A, 31B and four equally-spaced quadrant holes 32A, 32B, 33A, 33B, 34A, 34B, 35A, 35B. The quadrant holes are located in respective notional quadrants 36, 37, 38, and 39, each defining a 90 degree wedge of the button. According to one preferred embodiment, the diameter of the center hole 31A, 31B in a 10 mm button is 1.5 mm. The diameter of the four quadrant holes 32A, 32B, 33A, 33B, 34A, 34B, 35A, 35B is 1.2 mm. The quadrant holes 32A, 32B, 33A, 33B, 34A, 34B, 35A, 35B are equally spaced from the annular edge of the center hole 31A, 31B to the edge of the button 11, 12 a distance of 1.5 mm. In a second embodiment, the quadrant holes are spaced only 1.0 mm from the center hole and 2.0 mm from the edge of the button. While the disclosed 5-hole pattern in the buttons 11 and 12 is preferred, the principle of the invention applies to any arrangement of five or more button holes.

Figure 4:
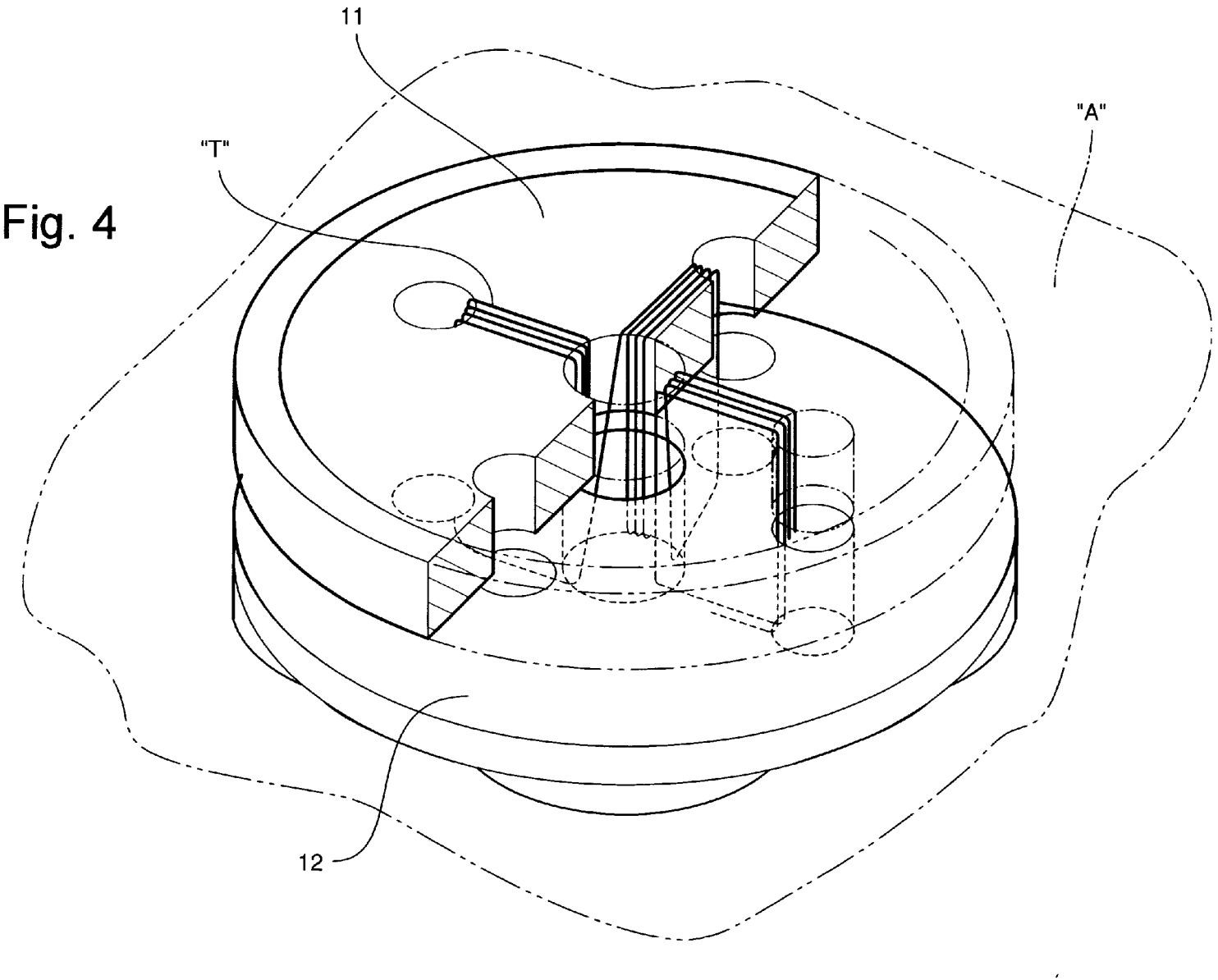
FIG. 4 is a perspective view of the buttons, as attached to an article, with a portion of the top button broken away in order to demonstrate the stitch pattern.

FIG. 4 demonstrates the stitch pattern used to attach the top and stay buttons 11, 12 to the article "A". In the electronic sewing machine, the stitch pattern is preferably controlled by suitable computer programming. An example of an electronic sewing machine with a computer controlled pattern selection system is provided in U.S. Pat. No. 4,512,271 incorporated herein by reference. In mechanical-type sewing machines, the stitch pattern may be controlled by a specially designed mechanical cam. In either case, the first stitch passes through respective aligned center holes 31A, 31B of the top and stay buttons 11 and 12. From the center holes 31A, 31B, the thread "T" is passed over to each of the aligned quadrant holes 32A, 32B, 33A, 33B, 34A, 34B, 35A, 35B, one hole at a time.

As an additional feature of the present anti-counterfeiting system, the attached 5-hole top button 11 may include the trademark of the brand owner. The stay button 12 is preferably color-coded to indicate brand participation in the system. The number of buttons used by any given manufacturer can be conveniently monitored by incorporating an electronic mechanism in each of the sewing machines for counting the number of buttons sewn.

An anti-counterfeiting system and method for authenticating manufactured articles is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

I claim:

1. A button adapted for use in an anti-counterfeiting system for authenticating a manufactured article, said button defining at least five holes adapted for receiving thread to attach said button to the manufactured article and said button comprising a stay button adapted for residing on an inside surface of the manufactured article, said stay button defining opposing major surfaces, and comprising a projecting cloverleaf configuration formed on one of said major surfaces.

2. A button according to claim 1, wherein said button comprises a relatively thin, circular disk having a center point and notional quadrants.

3. A button according to claim 2, wherein said button defines a center hole at the center point, and four quadrant holes outside of said center hole and located within respective notional quadrants.

4. A button according to claim 3, wherein said quadrant holes are equally spaced approximately 90 degrees apart.

5. A button according to claim 3, wherein each of said quadrant holes is equally spaced from the center hole of said button.

6. A button according to claim 3, wherein the diameter of the center hole is greater than the diameter of the quadrant holes.

7. An anti-counterfeiting method for authenticating a manufactured article, said method comprising the steps of attaching a five-hole top button to an outside surface of the manufactured article and a stay button to an inside surface of the manufactured article, the stay button underlying the top button adjacent the inside surface of the manufactured article.

8. An anti-counterfeiting method according to claim 7, wherein the step of attaching the top button comprises stitching a thread through each of the five holes of the top button, the article, and the underlying stay button.

9. An anti-counterfeiting method according to claim 7, wherein the step of attaching the top button further comprises making a first stitch through a center one of the five holes.

10. An anti-counterfeiting method according to claim 7, wherein the step of attaching the top button and the stay button to the article comprises using a single-thread chainstitch button sewing machine.

11. An anti-counterfeiting method according to claim 7, wherein the stay button defines five holes, and wherein the step of attaching the five-hole top button and the stay button to the article comprises aligning the holes of the top button and the stay button, and stitching a single thread through each of the aligned holes and article.

12. An anti-counterfeiting method according to claim 11, wherein the step of attaching the top button and the stay button to the article further comprises making a first stitch through respective aligned center holes formed in the top button and stay button.

* * * * *